US009199767B1

(12) United States Patent
Pheir

(10) Patent No.: US 9,199,767 B1
(45) Date of Patent: Dec. 1, 2015

(54) MULTI-COMPARTMENT ROLL-UP CONTAINER

(71) Applicant: Hirshol H. Pheir, St. Thomas, VI (US)

(72) Inventor: Hirshol H. Pheir, St. Thomas, VI (US)

( * ) Notice: Subject to any disclaimer, the term of this patent is extended or adjusted under 35 U.S.C. 154(b) by 0 days.

(21) Appl. No.: 14/621,542

(22) Filed: Feb. 13, 2015

(51) Int. Cl.

| | |
|---|---|
| ***B65D 25/04*** | (2006.01) |
| ***B65D 21/02*** | (2006.01) |
| ***B65D 25/38*** | (2006.01) |
| ***B65D 41/02*** | (2006.01) |
| ***B65D 83/06*** | (2006.01) |

(52) U.S. Cl.
CPC ..... *B65D 25/04* (2013.01); *B65D 21/0201* (2013.01); *B65D 25/38* (2013.01); *B65D 41/02* (2013.01); *B65D 83/06* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,190,196 | A | 7/1916 | Schweinert et al. | |
| 3,206,897 | A * | 9/1965 | Hilker | E04B 1/344 206/527 |
| 3,295,710 | A * | 1/1967 | Marchant | B29C 49/04 206/162 |
| 4,004,501 | A * | 1/1977 | Guerrero | A21C 15/02 220/23.8 |
| 4,081,101 | A * | 3/1978 | West | A01K 97/22 220/23.4 |
| 4,126,239 | A | 11/1978 | Gehrig et al. | |
| 4,320,846 | A * | 3/1982 | Meyering | B25H 3/023 206/390 |
| 4,799,590 | A | 1/1989 | Furman | |
| 4,890,741 | A * | 1/1990 | Edelstein | A45C 11/24 206/232 |
| 5,135,823 | A * | 8/1992 | Eales | B29C 49/20 215/6 |
| 5,676,253 | A * | 10/1997 | Hsu | B25H 3/023 206/372 |
| 5,676,274 | A * | 10/1997 | Green | B65D 11/00 220/23.8 |

(Continued)

FOREIGN PATENT DOCUMENTS

| | | |
|---|---|---|
| DE | 102 07 763 A1 | 9/2003 |
| FR | 1 503 901 | 12/1967 |

(Continued)

OTHER PUBLICATIONS

PCT, International Search Report and Written Opinion Dated Sep. 30, 2015, pp. 1-11.

*Primary Examiner* — Jacob K Ackun
(74) *Attorney, Agent, or Firm* — Gibb & Riley, LLC

(57) ABSTRACT

A method provides, as part of a computer administration system, an administration interface that can operate almost any computerized device having a user interface. The computer administration system manages components of a computer system and the administration interface is operable to configure the components and to provide dynamic performance and configuration information of the components to the user as the components operate. The method provides a "commentary input" area on the administration interface while providing performance and configuration information of a specific component or a set of components. Thus, the method can receive comment(s) about the specific component(s) of the computerized system in the commentary input area. When this occurs, the method stores the comment(s) in a data store in a manner that associates the comment(s) with the specific component(s) that was being monitored. The method also automatically stores contemporaneous component data with each comment in the data store.

20 Claims, 13 Drawing Sheets

(56) References Cited

U.S. PATENT DOCUMENTS

| | | | | | |
|---|---|---|---|---|---|
| 5,752,464 | A * | 5/1998 | King | A01K 5/0114 | 119/51.5 |
| 5,823,136 | A * | 10/1998 | Zarski | A01K 7/00 | 119/51.5 |
| D468,535 | S * | 1/2003 | McCormack | D3/273 | |
| D570,682 | S | 6/2008 | Erden | | |
| 7,665,634 | B2 * | 2/2010 | Pressler | A47K 5/1202 | 215/390 |
| 7,810,667 | B2 * | 10/2010 | Douglas | B65B 43/123 | 206/390 |
| 8,338,357 | B2 | 12/2012 | Gibis et al. | | |
| 2004/0149774 | A1 | 8/2004 | Strong | | |
| 2011/0095021 | A1 * | 4/2011 | Clough | B65D 75/56 | 220/23.83 |
| 2013/0206772 | A1 | 8/2013 | Halbherr et al. | | |

FOREIGN PATENT DOCUMENTS

| | | |
|---|---|---|
| GB | 2 305 162 | 4/1997 |
| WO | 01/44065 A1 | 6/2001 |
| WO | 2005/110872 A1 | 11/2005 |

* cited by examiner

MULTI-COMPARTMENT ROLL-UP CONTAINER

CROSS-REFERENCE TO RELATED APPLICATIONS

This application is related to the following co-pending applications filed concurrently herewith by the same Applicant: Multi-Compartment Roll-Up Container-Triangle", Ser. No. 29/517,510, "Multi-Compartment Roll-Up Container-Rounded", Ser. No. 29/517,512, and "Multi-Compartment Roll-Up Container-Rounded Different Sizes", Ser. No. 29/517,514. The complete disclosures of these co-pending applications are incorporated herein by reference.

BACKGROUND

Systems and methods herein generally relate to watertight and airtight containers, and more particularly to containers that contain multiple compartments.

Ever since the first clay pots were baked in open ovens thousands of years ago, containers have taken many different forms, shapes, and sizes. Indeed, watertight and airtight containers are indispensable in modern society; however, traditional containers generally maintain a single compartment that allows all contents therein to mix. Further, while some multi-compartment containers exist, such containers keep the different compartments at fixed positions with respect to one another, which can make such containers bulky and difficult to package, transport, etc.

SUMMARY

Generally, a multi-compartment container structure disclosed herein has individual containers connected together. All the individual containers can have the same size and shape. Each of the individual containers has a flat base wall. Each of the individual containers is joined to immediately adjacent containers of the container structure by joints at wall edges of the flat base wall. The joints have a greater flexibility relative to the flat base wall. In other words, the base walls of adjacent individual containers are joined to one another by relatively more flexible joints.

The flat base wall of each individual container lies in the same plane when the multi-compartment container structure is in an unrolled state, but each flat base wall of the individual containers lies in different parallel planes when the container structure is in a rolled-up state. The combination of flat base walls of the individual containers forms a multi-planar exterior of the container structure when the container structure is in the rolled-up state. The individual containers comprise watertight and airtight caps that are positioned adjacent each other when the container structure is in the rolled-up state.

Another exemplary multi-compartment container structure herein also has individual containers connected together, and all the individual containers can have the same size and shape. In one example, the individual containers can have a triangular-shaped tubular body. The triangular-shaped tubular body has three flat walls sealed to each other and the flat walls form a triangular shape in cross-section of the tubular body. Also, triangular end walls form watertight and airtight seals at the ends of the triangular-shaped tubular body. In addition, a cap provides a removable watertight and airtight seal for fill/dispense openings of the triangular end walls.

In this structure, each of the individual containers is joined to immediately adjacent containers of the container structure by joints at wall edges of a flat base wall (which is one of the three flat walls forming the triangular-shaped tubular body). Again, the joints have a greater flexibility relative to the flat base wall. The flat base wall of each the individual containers lie in the same plane when the container structure is in the unrolled state. Each flat base wall of the individual containers lies in different parallel planes when the multi-compartment container structure is in a rolled-up state. The rolled-up state occurs when two flat base walls of adjacent ones of the individual containers fold relative to one another along one of the joints. The combination of flat base walls of the individual containers forms a multi-planar exterior of the container structure when the container structure is in the rolled-up state.

The watertight and airtight caps of the individual containers are positioned adjacent each other when the container structure is in the rolled-up state. The positions of the watertight and airtight caps of the individual containers (when the container structure is in the rolled-up state) allow all the watertight and airtight caps of the container structure to be grasped and opened simultaneously by the user. Similarly, the fill/dispense openings of the individual containers are all positioned adjacent each other when the container structure is in the rolled-up state. Thus, when in the rolled-up state, the fill/dispense openings of the container structure are positioned to cause contents (e.g., liquid material, granular dry material, etc.) of the individual containers to mix after being dispensed (e.g., to mix when the watertight and airtight caps are opened and the contents is poured out the fill/dispense openings). However, when the watertight and airtight caps are sealing the individual containers, the individual containers and the watertight and airtight caps prevent the contents maintained in different individual containers from mixing.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As shown in the accompanying drawings (discussed in detail below) various multi-compartment containers are disclosed herein. Such containers can hold individual premeasured ingredients that are kept separate until needed for use/consumption. When rolled-up, the individual containers form an overall larger container that positions all individual container fill/dispense openings in one location. Then, the caps of the rolled-up container can be 'twisted' open and the contents of the individual containers can be poured into a receptacle (glass, pitcher, blender, etc.). Thus, when the flat set of individual containers (e.g., "pouches") is rolled into a cylindrical shape, the caps (e.g., cork, stopper, perforated neck, etc.) are all in the same location and can be twisted, causing the caps to be separated from the top of the container. The contents can then be poured through the individual fill/dispense openings of the different containers into a pitcher of ice, a blender, a glass, etc., to be used or consumed.

Figure 1:
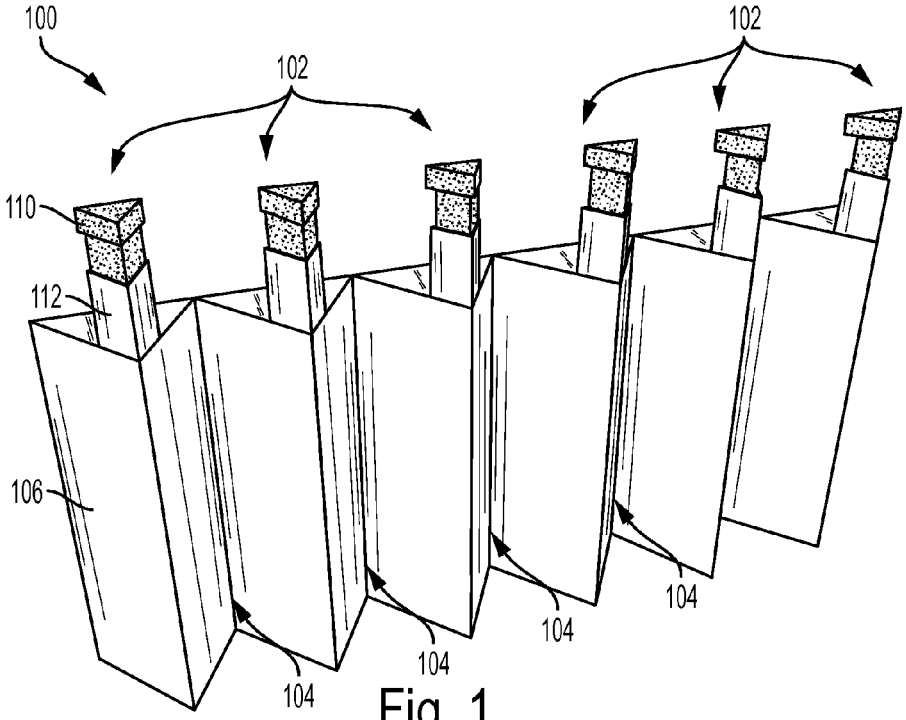
FIG. 1 is a perspective drawing illustrating devices herein in an unrolled position.

FIG. 1 illustrates one perspective view of an exemplary multi-compartment container structure 100 herein. As shown in FIG. 1, this exemplary multi-compartment container structure 100 has individual containers 102 connected together, and all the individual containers 102 can have the same size and shape. In one example, the individual containers 102 can have a triangular-shaped tubular body 106. Other examples of differently shaped containers are discussed below.

The initial example presented in this disclosure has a triangular-shaped tubular body 106 that has three flat walls sealed to each other, and the three flat walls thereby form a triangular shape in a cross-section of the tubular body 106. See FIGS. 2, 4, 6, 8, etc., that illustrate how the triangular-shaped tubular body 106 has a triangular shape in cross-section. Also, as shown for example in FIGS. 2, 4, 6, 8, etc., triangular end walls 118 seal the ends of the triangular-shaped tubular body 106.

Figure 2:
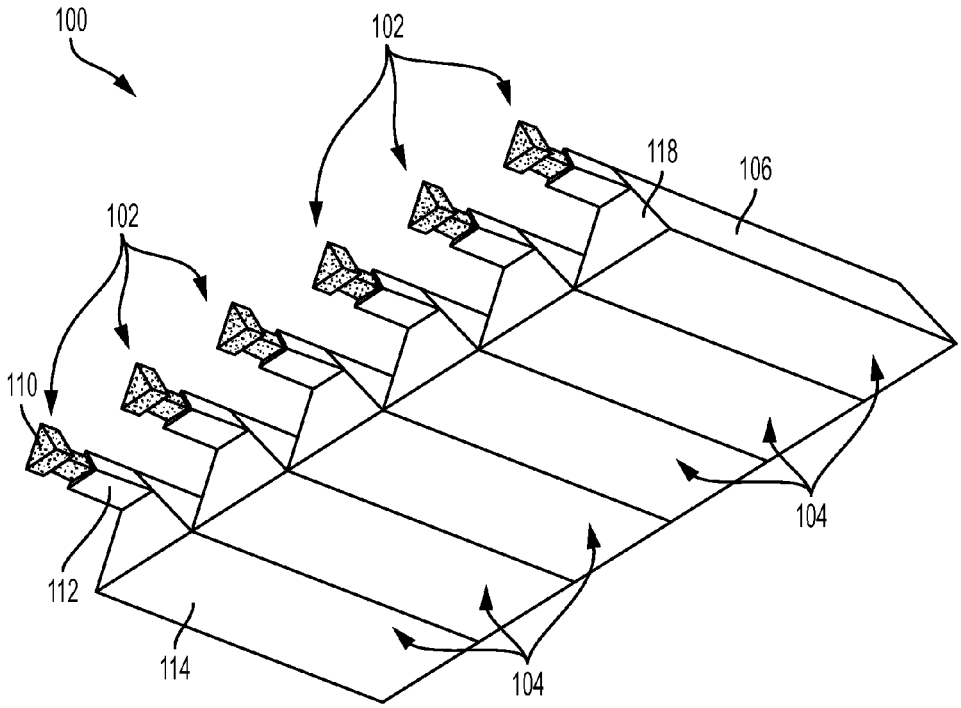
FIG. 2 is a perspective drawing illustrating devices herein in an unrolled position.

In addition, a removable watertight and airtight cap 110 seals fill/dispense openings 112 of the triangular end walls 118. The openings 112 can be in the form of a neck or spout that are sealed with a screw-on cover, cork-type or stopper-type plug device, etc., 110, as shown in FIG. 1. Alternatively, item 112 can be fill/dispense openings or holes in the end walls 118 that will be opened when the caps or plugs/corks 110 are removed from the end walls 118, as shown in FIG. 2. Note that in FIG. 2, there is no neck and the cap 110 forms the entire protrusion from the end wall 118, and when the protrusion/cap 110 is removed from the end wall 118, an opening 112 will remain in the end wall 118.

In this structure, each of the individual containers 102 is joined to immediately adjacent containers of the container structure by joints 104 at wall edges of a flat base wall 114 (of the three flat walls). The joints 104 have a greater flexibility relative to the flat base wall 114 (either by being thinner or by being made of a different material) thereby allowing adjacent flat base walls 114 to fold relative to one another around a corresponding joint 104.

Figure 3:
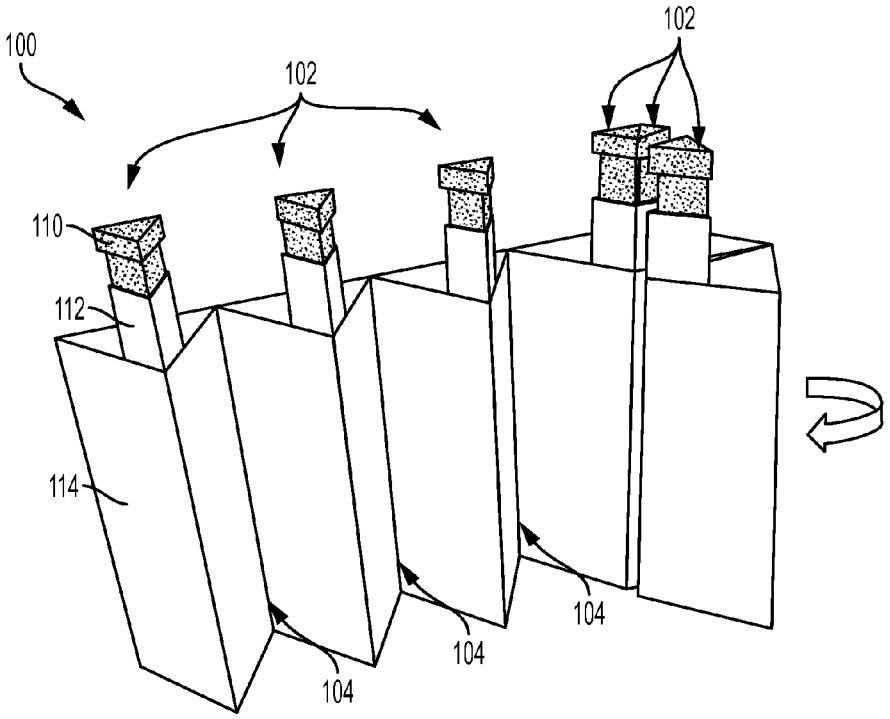
FIG. 3 is a perspective drawing illustrating devices herein in a partially rolled-up position.
Figure 4:
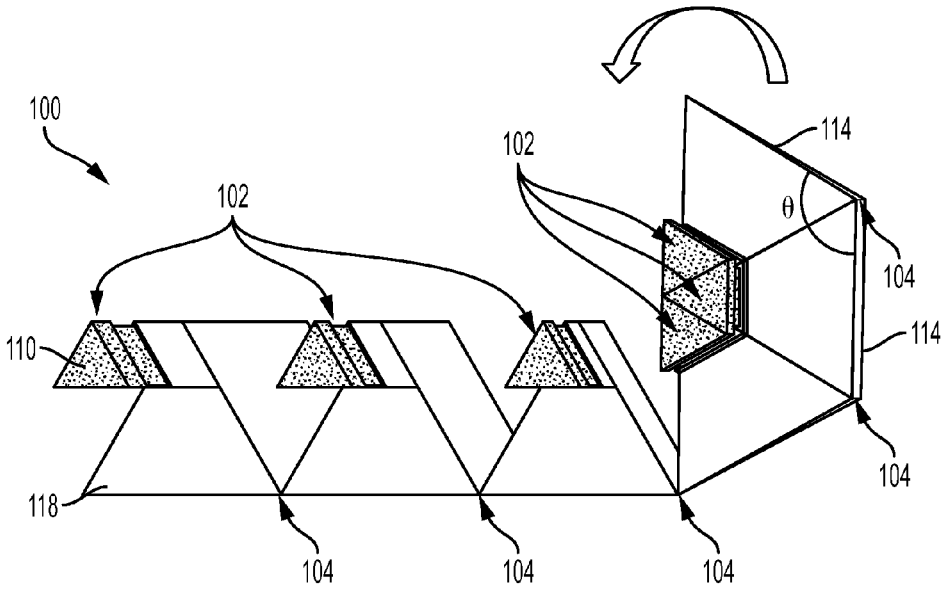
FIG. 4 is a perspective drawing illustrating devices herein in a partially rolled-up position.
Figure 5:
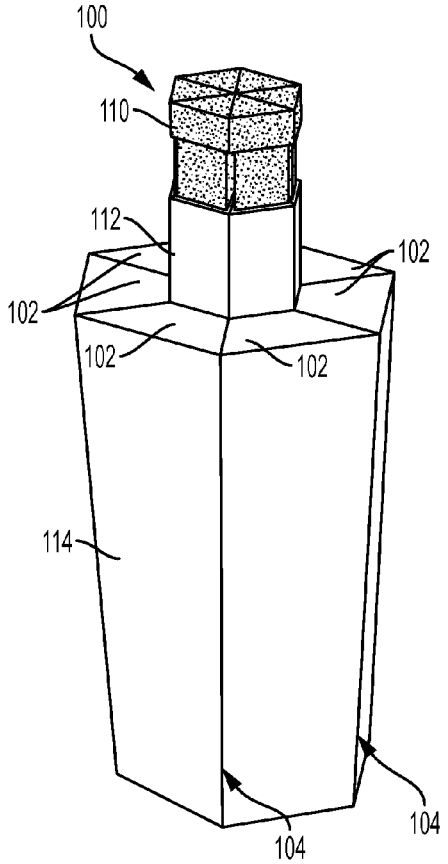
FIG. 5 is a perspective drawing illustrating devices herein in a rolled-up position.
Figure 6:
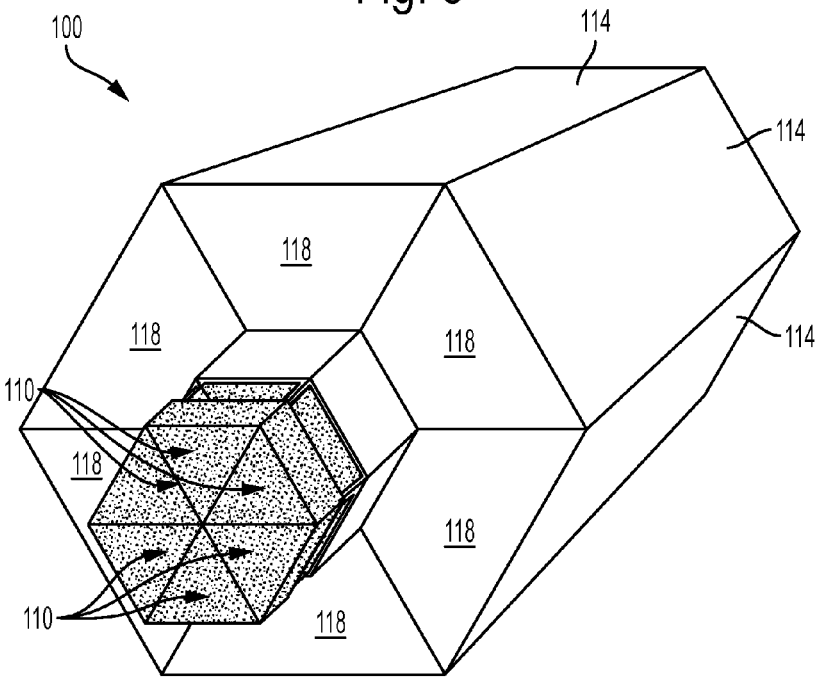
FIG. 6 is a perspective drawing illustrating devices herein in a rolled-up position.

As shown in FIG. 2, the flat base wall 114 of each the individual containers 102 lies in the same plane when the container structure is in the unrolled state. However, as shown in FIG. 5-6, each flat base wall 114 of the individual containers 102 lies in different parallel planes when the multi-compartment container structure is in a rolled-up state. The rolled-up state occurs when two flat base walls 114 of adjacent ones of the individual containers 102 fold relative to one another along one of the wall edges 104 (as shown in perspective view in FIG. 3 and in top-view in FIG. 4 which shows the container structure 100 in the partially rolled-up state, where the rolling action is shown by block arrows). As shown in FIG. 4, two adjacent flat base walls 114 are folded relative to one another when the planes of the two adjacent flat base walls 114 are at a non-zero angle (0) with respect to each other (and such an angle is formed at the wall edge 104). As shown for example in FIG. 5-6, the combination of flat base walls 114 of the individual containers 102 forms a multi-planar exterior of the container structure when the container structure is in the rolled-up state, as shown in FIGS. 5 and 6.

As shown in FIGS. 5 and 6, the watertight and airtight caps 110 of the individual containers 102 are positioned adjacent each other when the container structure is in the rolled-up state. The positions of the watertight and airtight caps 110 of the individual containers 102 (when the container structure is in the rolled-up state) allow all the watertight and airtight caps 110 of the container structure to be grasped and opened (e.g., removed, twisted-off, torn-off, pulled-out, unscrewed, etc.) simultaneously, as shown by the block arrow in FIG. 7. FIG. 8 also shows that the fill/dispense openings 112 of the individual containers 102 are all positioned adjacent each other when the container structure is in the rolled-up state after the caps 110 are removed.

When the watertight and airtight caps 110 are sealing the individual containers 102 (e.g., as shown in FIGS. 1-6) the individual containers 102 and the watertight and airtight caps 110 prevent the contents maintained in different individual containers 102 from mixing (and/or being dispensed).

Figure 7:
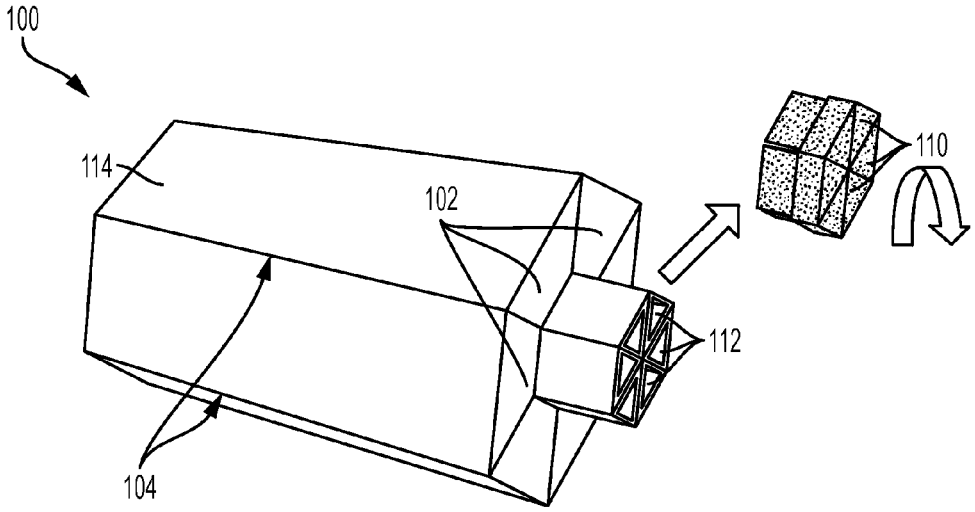
FIG. 7 is a perspective drawing illustrating devices herein in a rolled-up position.
Figure 8:
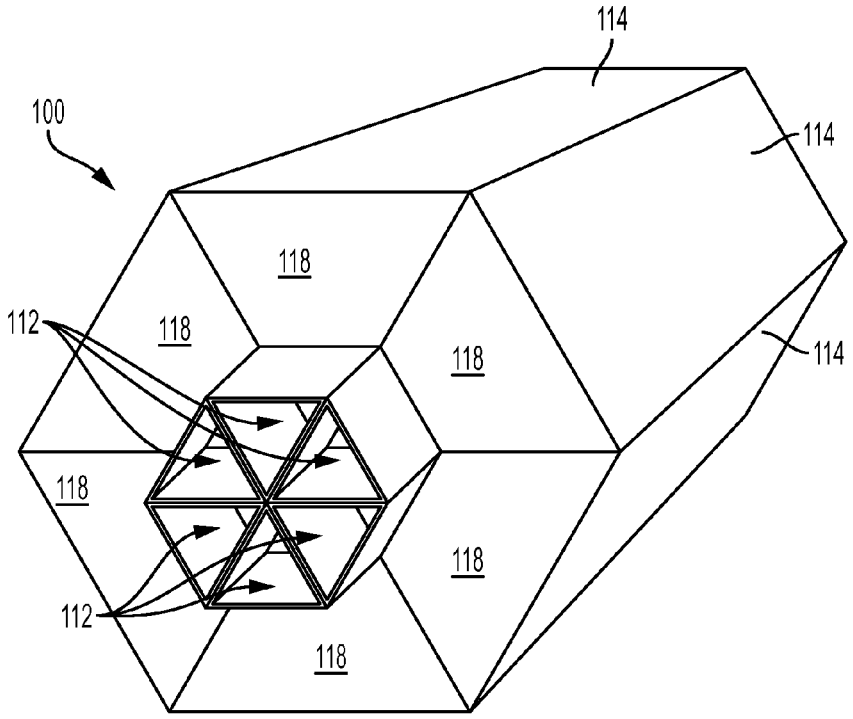
FIG. 8 is a perspective drawing illustrating devices herein in a rolled-up position.

In one example, the watertight and airtight caps 110 are sized and positioned (when in the container structure 100 is in the rolled-up state) to be easily grasped simultaneously by a human user's hand or fingers, allowing the user to simultaneously twist, pull, tear, etc., all the watertight and airtight caps 110 of a given container structure 100 in a single motion, so as to simultaneously remove all watertight and airtight caps 110 from all individual containers 102 of the given container structure 100 (and this is illustrated by the block arrows in FIG. 7). This process is aided by the triangular shape of the caps 110 in this example, which fit against one another when the container structure 100 is in the rolled-up state (as shown, for example, in FIG. 6); and the combination of such triangular-shaped caps 110 (when positioned in the rolled-up state) forms an overall hexagonal-shaped cap structure, in this example.

Thus, as shown in the drawings, the user can grab or pinch the overall hexagonal-shaped cap structure (created by the combination of the individual triangular-shaped caps 110 in the rolled-up structure) using their fingers or the palm on their hand, allowing the user to simultaneously grasp all caps 110 and simultaneously remove all caps 110 from the rolled-up structure 100 in one twisting, pulling, cutting, and/or tearing user motion.

Figure 9:
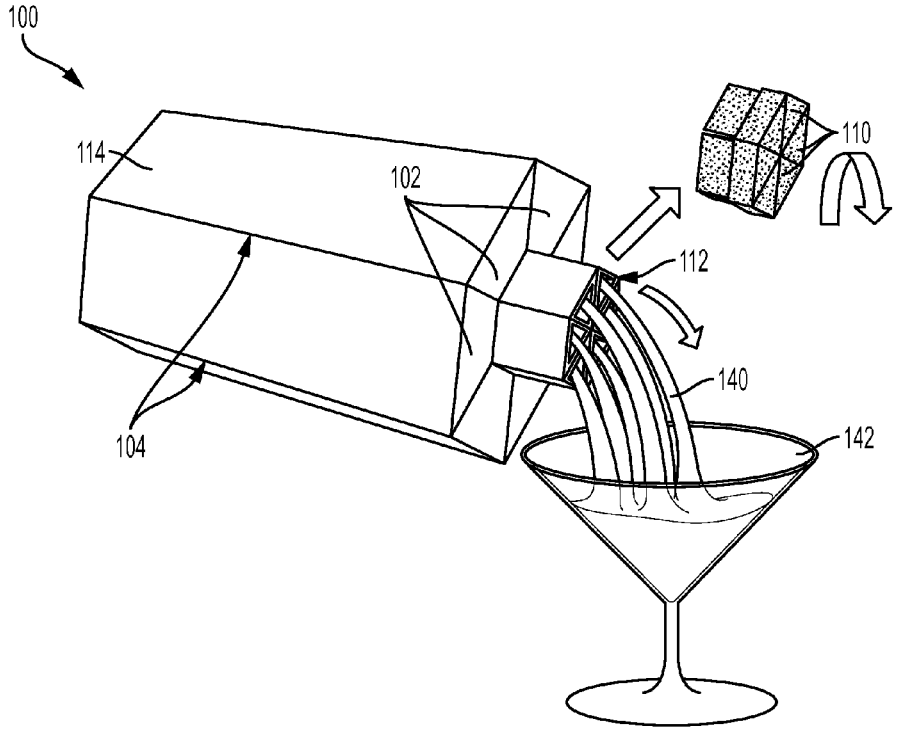
FIG. 9 is a perspective drawing illustrating devices herein in a rolled-up position dispensing contents.
Figure 10:
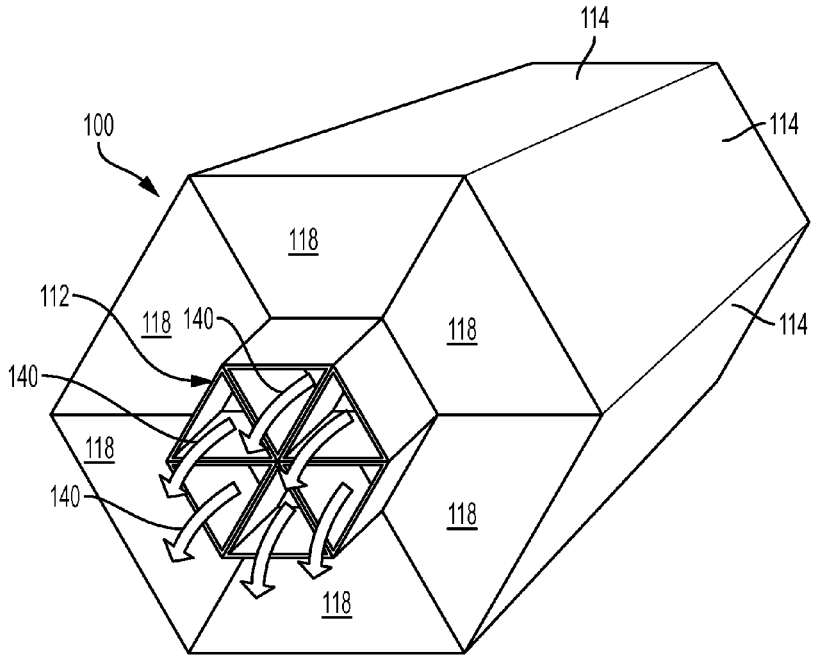
FIG. 10 is a perspective drawing illustrating devices herein in a rolled-up position dispensing contents.

Thus, as shown in FIGS. 9 and 10, when in the rolled-up state, the fill/dispense openings 112 of the container structure are positioned to cause contents 140 (e.g., liquid material, granular or powdered dry material, etc.) of the individual containers 102 to be dispensed and to mix when the watertight and airtight caps 110 are opened and the contents 140 is poured out the fill/dispense openings 112 and into a container 142, such as a drinking glass. More specifically, FIG. 10 illustrates many block arrows (identified by reference number 140) and this illustrates that different materials 140 are simultaneously dispensed from different openings 112, and that the different materials 140 combine (e.g., mix together) as they are being dispensed from the different openings 112. This is also shown in FIG. 9 where the dispensed material 140 is shown as mixing into a single stream as it enters the container 142. In other words, the dispensed material 140 begins as individual streams as it exits each different opening 112; however, these individual streams at least partially combine as they are poured together and as they enter the container 142. The user can perform additional mixing of the different materials after the dispensed material 140 has been poured into the container 142.

Note, that in FIG. 10, the individual openings 112 are only identified using a single identification number (112) to avoid clutter in the drawings; however, FIG. 8 uses individual identification numerals for each individual fill/dispense opening, and the structure in FIGS. 8 and 10 is the same, except that in FIG. 10 the material 140 is shown as being dispensed. Also, FIGS. 9 and 10 illustrate that the rolled-up container structure 100 is tilted by the user (so that the end having the fill/dispense openings 112 is lower (relative to the surface of the earth) than the opposite end of the container structure 100) to allow the earth's gravitational force to cause the material contents 142 to exit the fill/dispense openings 112.

Figure 11:
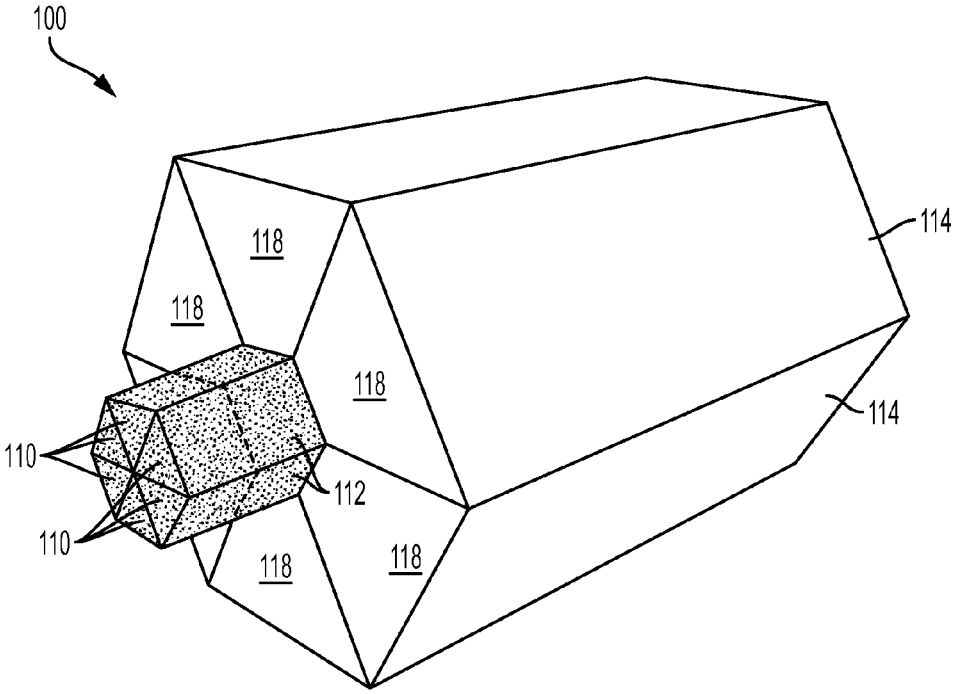
FIG. 11 is a perspective drawing illustrating devices herein in a rolled-up position.
Figure 12:
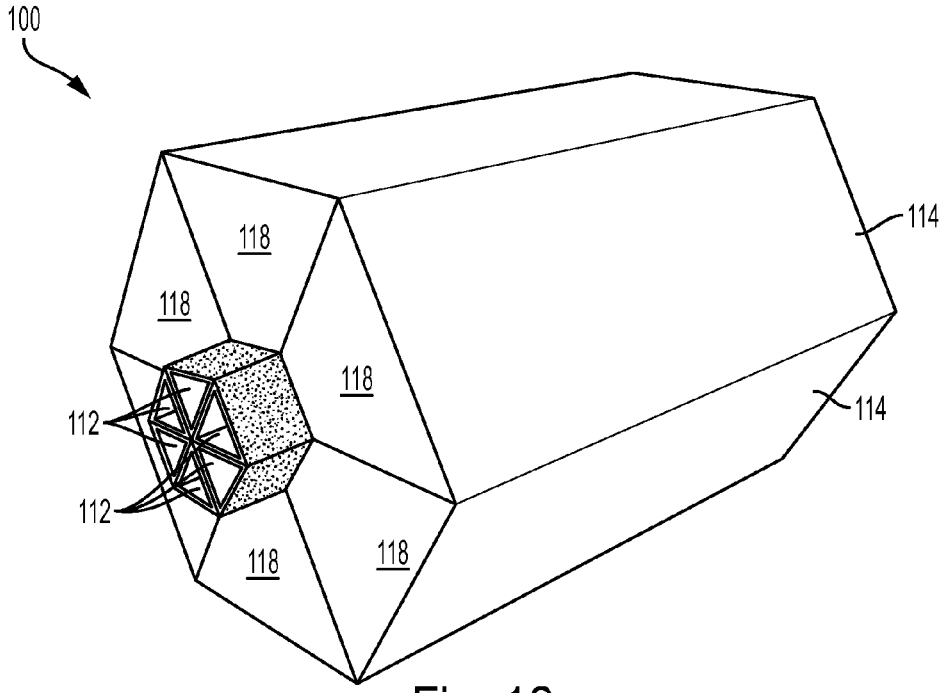
FIG. 12 is a perspective drawing illustrating devices herein in a rolled-up position.

FIGS. 11 and 12 provide a different view of the structure, which more clearly illustrates an optional perforation feature between the caps 110 and the fill/dispense openings 112. More specifically, in FIG. 11, the perforations (shown as dashed lines) can be more easily seen between the caps 110 and the fill/dispense openings 112. Such perforations do not disturb the watertight/airtight seals of the individual containers 102, but merely make tearing/removing the caps 110 from the openings 112 easier for the user by weakening the material in the area of the perforations (through scoring, forming incomplete holes that do not pass fully through the material, etc.). In FIG. 12, the fill/dispensed caps 110 have been removed (as discussed above) allowing the fill/dispense openings 112 to be available to simultaneously dispense/mix the contents of the different individual containers 102.

Figure 13:
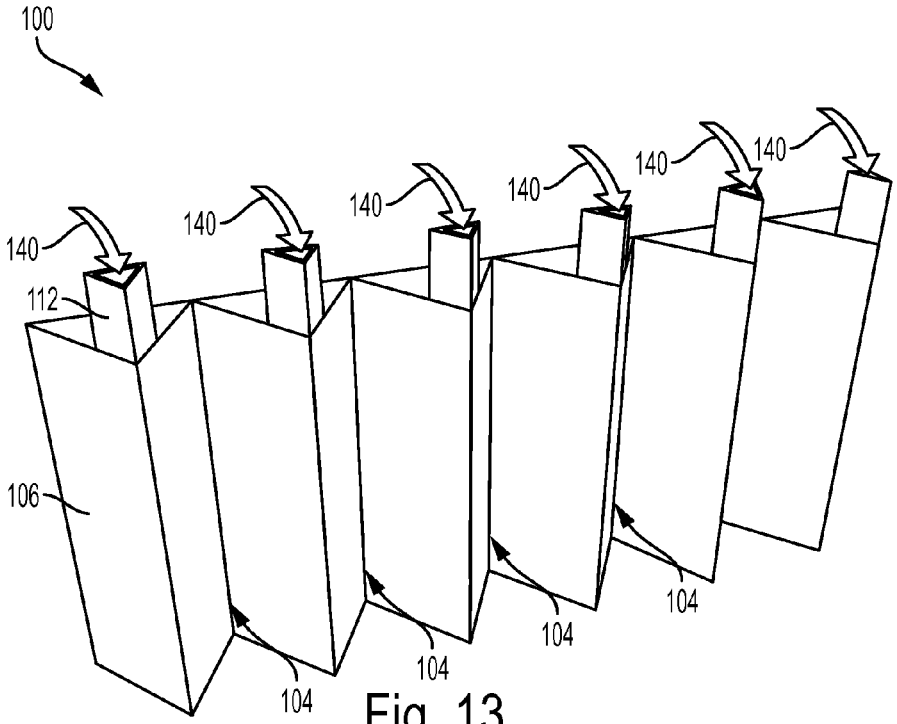
FIG. 13 is a perspective drawing illustrating devices herein in an unrolled position being filled with contents.
Figure 14:
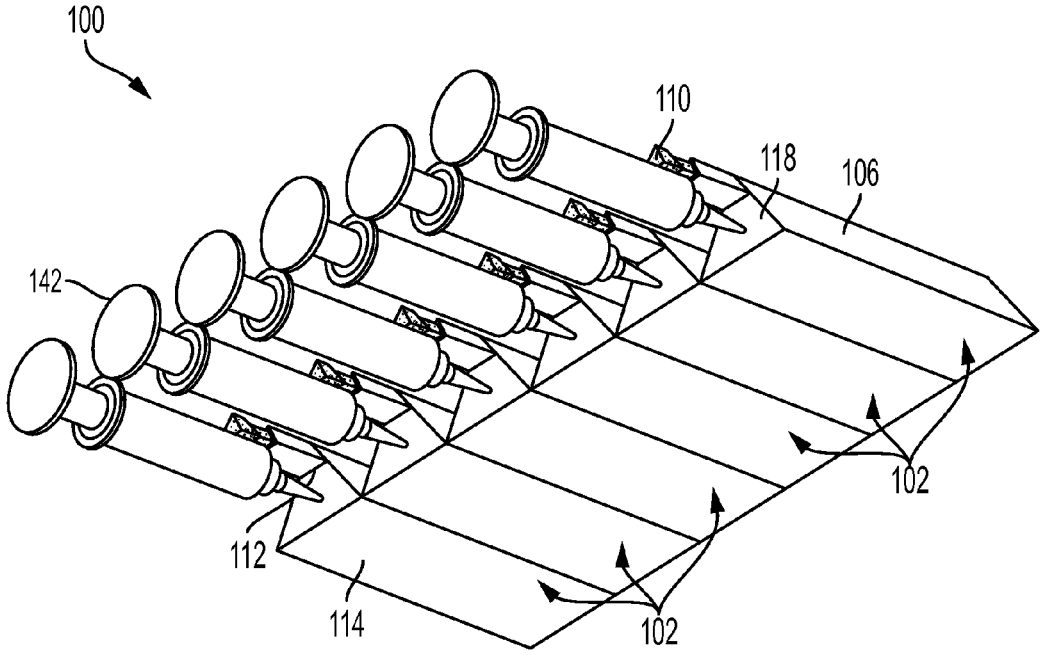
FIG. 14 is a perspective drawing illustrating devices herein in an unrolled position being filled with contents.
Figure 15:
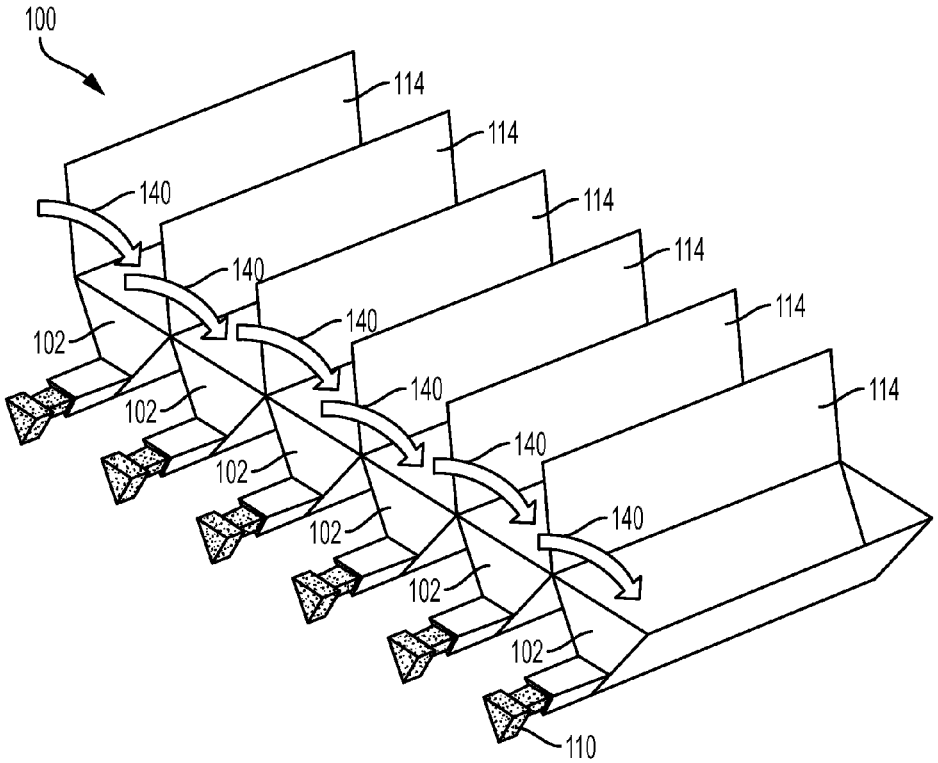
FIG. 15 is a perspective drawing illustrating devices herein in an unrolled position being filled with contents.

In the previous portions of this disclosure, the openings 112 have been described as fill/dispense openings, meaning that the openings 112 can be used to fill the individual containers 102 with different materials 140, and/or can be used for dispensing the contents 140 from the individual containers 102. In furtherance of this concept, FIGS. 13-15 shows some exemplary ways in which the individual containers 102 can be filled with the different materials 140. For example, as shown in FIG. 13, the caps 110 are not in place, allowing the contents 140 to be placed, poured, pumped, injected, etc., into the individual containers 102 through the fill/dispense openings 112 (after which the caps 110 are positioned to seal the openings 112).

Alternatively, as shown in FIG. 14, various different injection processes (represented by symbolic injection devices 142) can be utilized to inject different materials into the different individual containers. For example, the container structure 100 can be made of a somewhat flexible material that can be self-sealing if a small enough injection hole is utilized to inject the material. Alternatively, the injection process can be combined with a heating process that re-melts the material of the container structure 100, thereby sealing any injection holes as they are made. Additionally, those ordinarily skilled in the art we understand that many other types of self-sealing injection methodologies can be utilized with the structures disclosed.

In an alternative structure that aids in the filling of the individual containers 102, FIG. 15 illustrates that the flat base wall 114 can comprise a flap that can be open to allow the different materials 140 to be inserted, placed, poured, pumped, injected, etc., into the individual containers 102. After the material 140 is inserted into the individual containers, the flat base wall 114 is sealed to the other walls (to create the structure shown in FIG. 2, for example) to again create the watertight and airtight sealed individual containers 102 that are described above.

While a few exemplary methodologies and structures for filling the individual containers 102 are described above, those ordinarily skilled in the art would understand that many other methodologies could be utilized to fill the individual containers with different materials 140. Further, these materials 140 can be any form of materials, liquids, solids, crystalline materials, powdered materials, liquids containing solids, pressurize materials, carbonated materials, etc.

Figure 16:
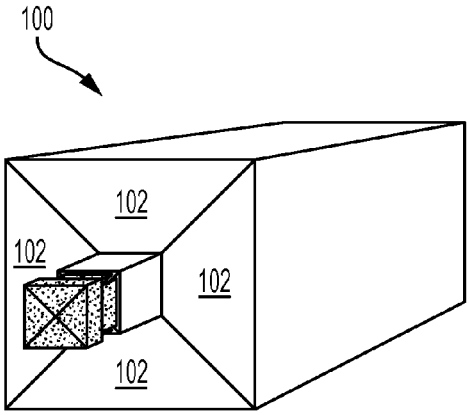
FIG. 16 is a cross-sectional drawing illustrating devices herein in a rolled-up position.
Figure 17:
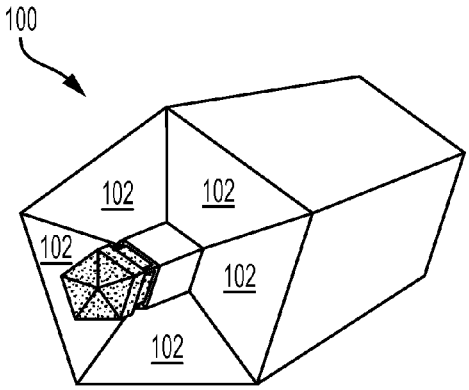
FIG. 17 is a cross-sectional drawing illustrating devices herein in a rolled-up position.

Additionally, while the foregoing examples have presented individual containers 102 that have a triangular-shaped tubular body 106, and that when rolled-up form a hexagonal-shaped structure, those ordinarily skilled in the art would understand that many other shapes could be utilized. Also, the previous examples form a hexagonal-shaped structure when in the rolled-up state because six individual containers are included within the example shown above. However, the number of sides the rolled-up container will contain is only dependent upon the number of individual containers 102 that are connected by the joints 104. Therefore, if there are four individual containers 102, the resulting rolled-up container structure will have four sides (as shown in cross-sectional view in FIG. 16); similarly, if there are five individual containers 102, the resulting rolled-up container structure will have five sides (as shown in cross-sectional view in FIG. 17).

Further, the number and/or cross-sectional size of individual containers 102 that are included within a single container structure 100 may be subject to the usage of the container. If, for example, a user-consumable drink that contains three distinct substances (e.g., water in one individual container, powered flavoring in one individual container, and sugar in one individual container) may only include three individual containers (if each container has sufficient volume to hold a prescribed quantity of material), which would result in a triangular-shaped container when rolled-up. Some of the individual containers can contain the same material, depending upon quantity requirements. Thus, those skilled in the art would understand that the rolled-up container structure herein can contain as many sides as there are individual containers and can be triangular, square, pentagonal, hexagonal, etc., and the number of individual containers may depend upon what the container structure 100 maintains. Therefore, containers having a triangular-shaped tubular body 106 and a rolled-up container having a hexagonal shape are only examples, and the disclosed structure is intended to include all shaped individual and rolled-up structures.

Figure 18:
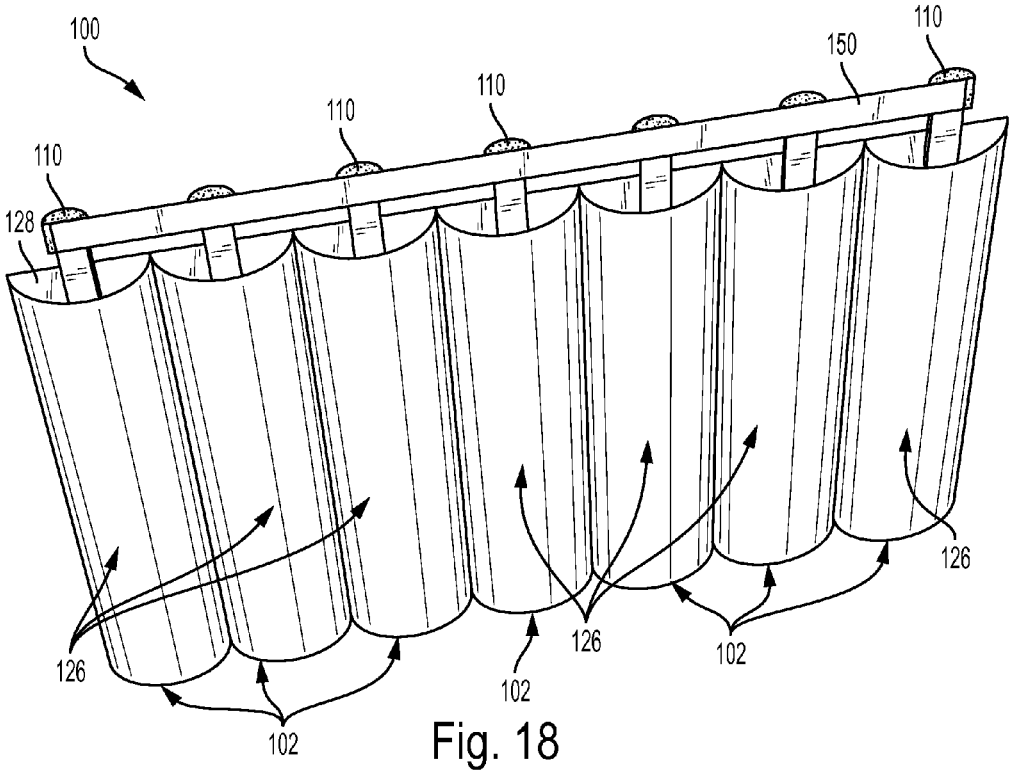
FIG. 18 is a perspective drawing illustrating devices herein in an unrolled position.
Figure 19:
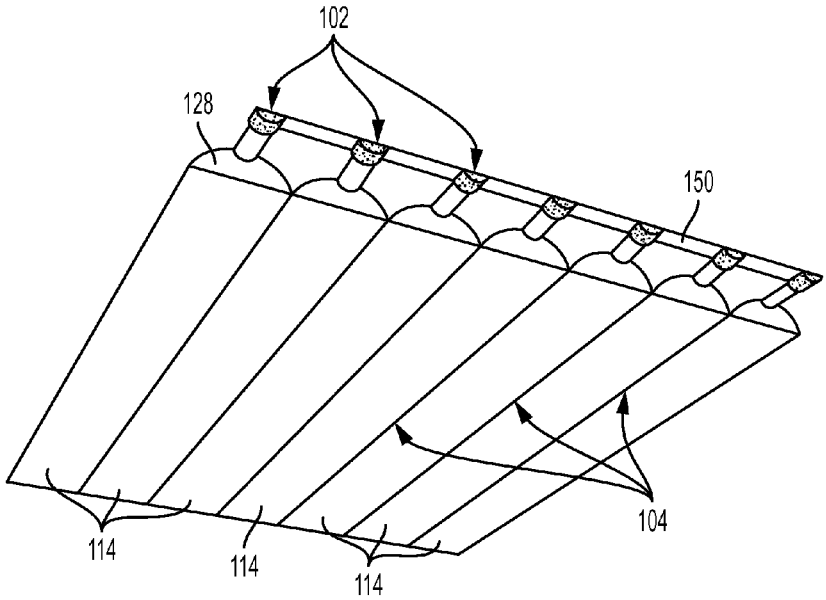
FIG. 19 is a perspective drawing illustrating devices herein in an unrolled position.

Further, so long as each of individual containers 102 include a flat face wall 114, and the joints 104 between the individual containers 100 allow the container structure 100 to be rolled-up, the remaining structure of the individual containers 102 can take almost any shape. Therefore, for example, as shown in FIGS. 18 and 19, the remaining structure of individual containers 126 can have a curved shape, and this curve shaped portion 126 in FIGS. 18 and 19 can be flexible (e.g., as a bag, pouch, or pouch-like structure and becomes curved as it is filled with contents) or the curve shaped portion 126 can be non-flexible and remain curved in all situations (whether full or empty).

Figure 20:
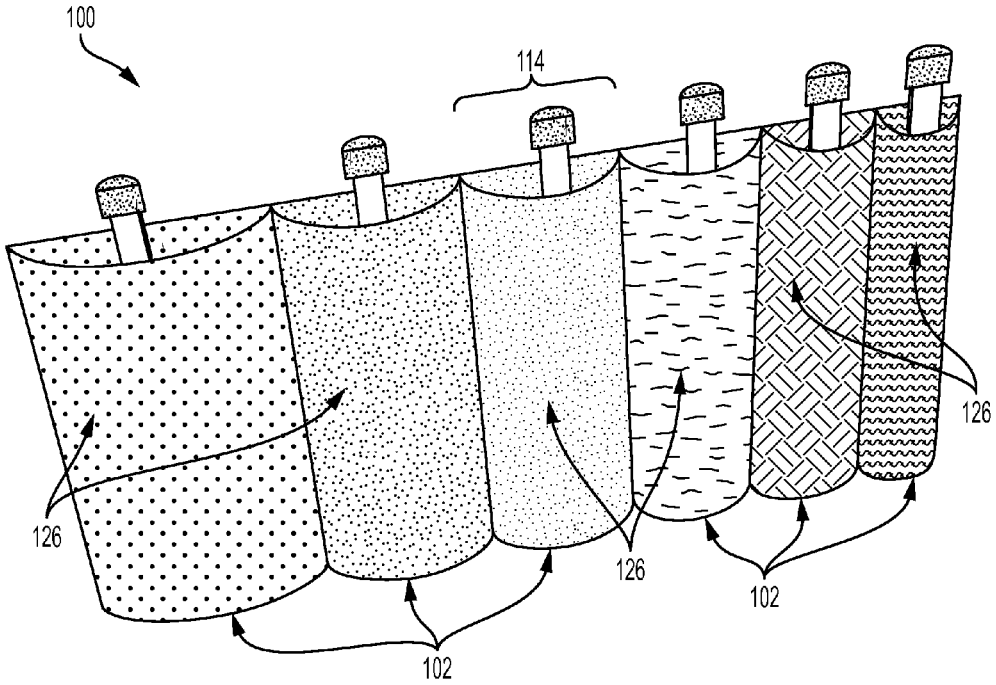
FIG. 20 is a perspective drawing illustrating devices herein in an unrolled position.

In FIG. 20, the pouch-like structures 126 are shown to have different sizes. Additionally, each flat face wall 114 can comprise many different flat sections 124 that run from end wall 118 to end wall 118. The flat sections 124 of each flat face wall 114 can be more easily seen in FIG. 21, which illustrates the structure shown in FIG. 20 in partially rolled-up form. FIG. 22 illustrates the same structure shown in FIGS. 20 and 21 in fully rolled-up form.

Figure 21:
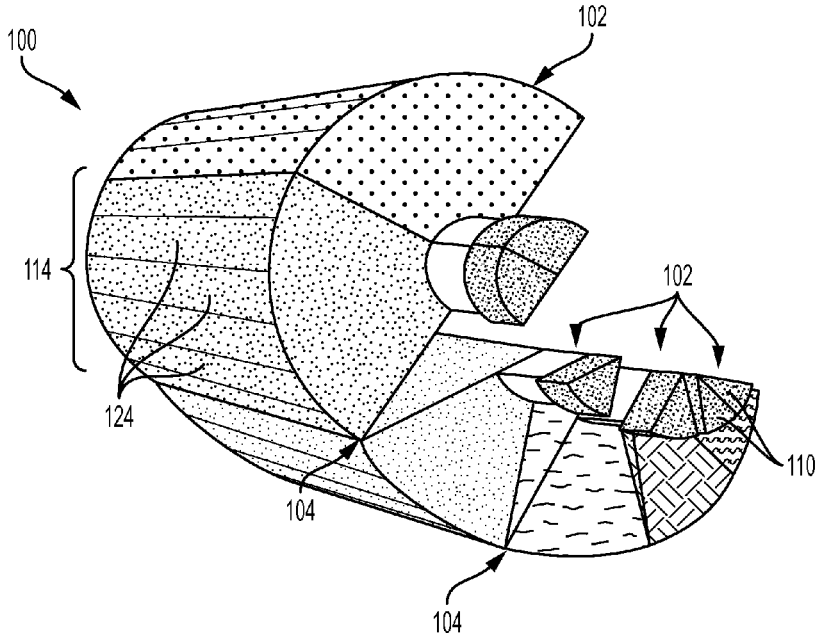
FIG. 21 is a perspective drawing illustrating devices herein in a partially rolled position.
Figure 22:
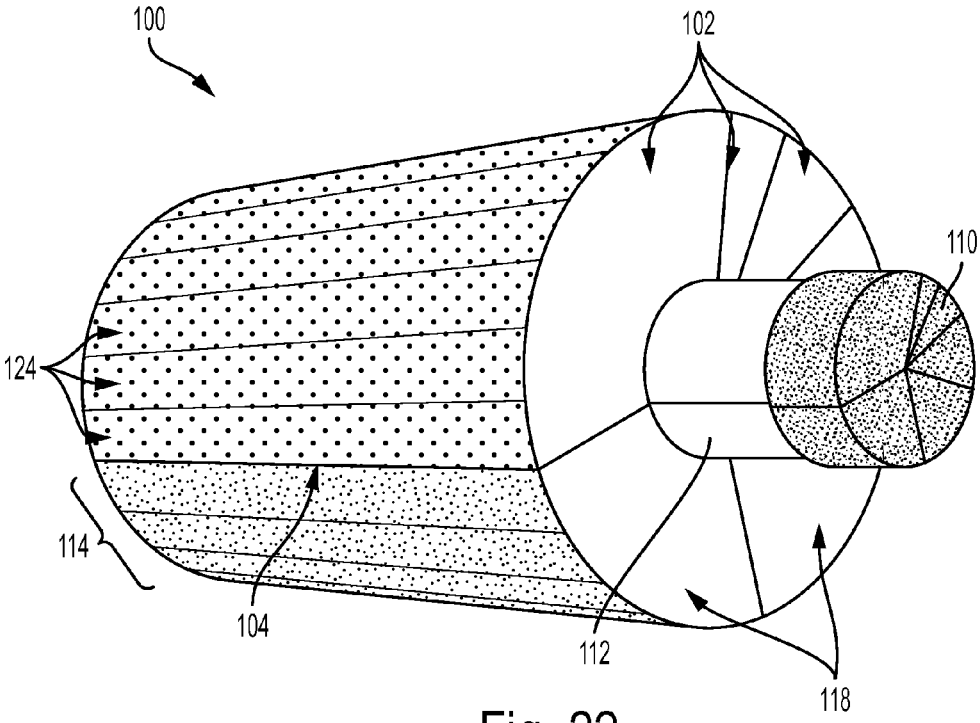
FIG. 22 is a perspective drawing illustrating devices herein in a rolled-up position.

As can be seen in FIGS. 20-22, the 'rigid' outer shell 114 (i.e. the exterior 114 when rolled-up) can be strips of rigid material 124. Also, as shown, there can be many strips 124 of rigid material for each of the inner softer/malleable pouches/bags 126, such that each relatively more flexible pouch/bag 124 spans multiple lengths of the rigid strips 124. When the container is flat or unrolled, it sits flat because the inner pouches/bags 124 are flexible and soft, and the inner pouches/bags 124 spread evenly over the rigid strips 124. However, when rolled, because of the rigid outer shell 114/124, the container forms the shape of a cylinder (FIG. 22), and the inner softer pouches/bags 124 change shape to fill the interior of the cylinder.

Figure 23:
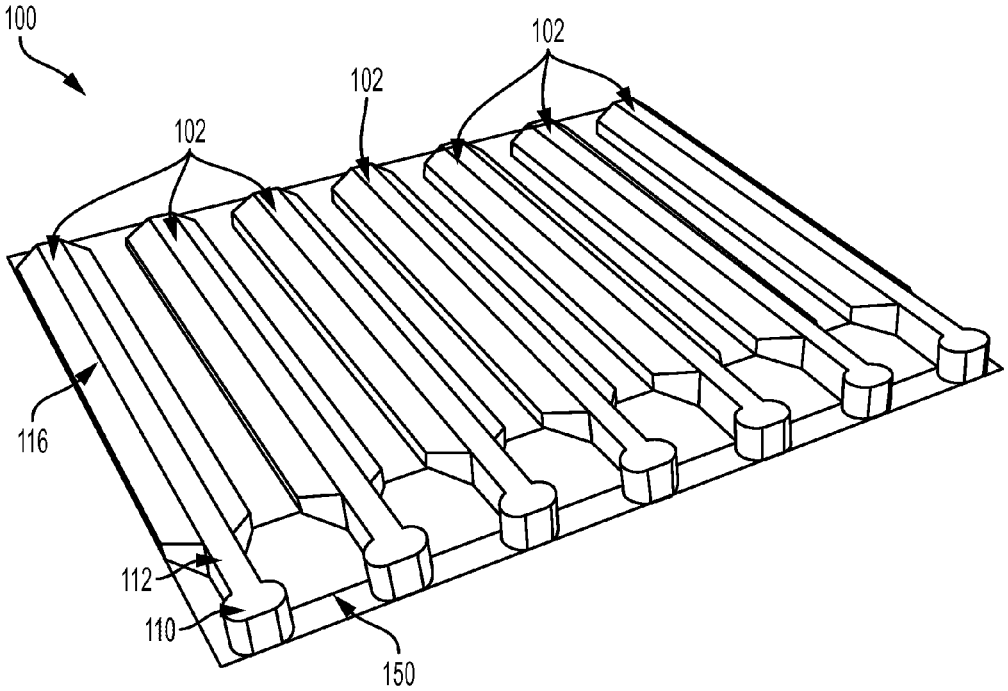
FIG. 23 is a perspective drawing illustrating devices herein in an unrolled position.
Figure 24:
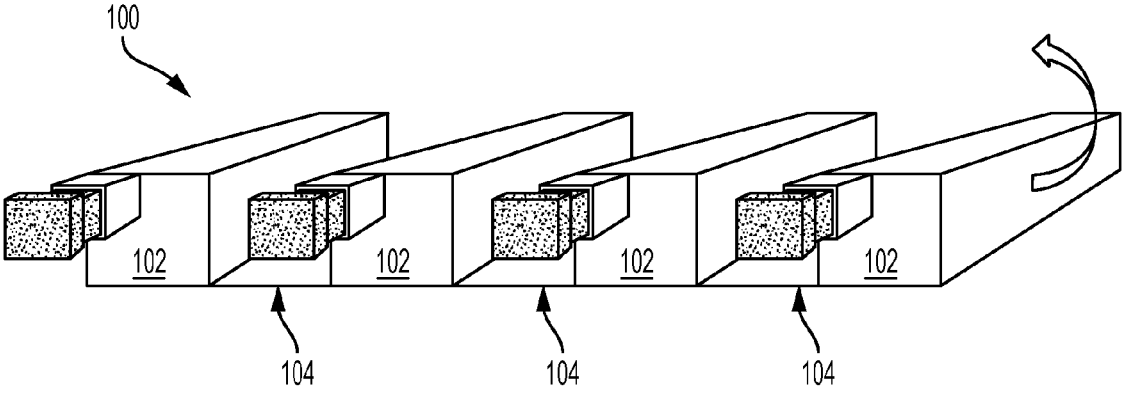
FIG. 24 is a cross-sectional drawing illustrating devices herein in an unrolled position.
Figure 25:
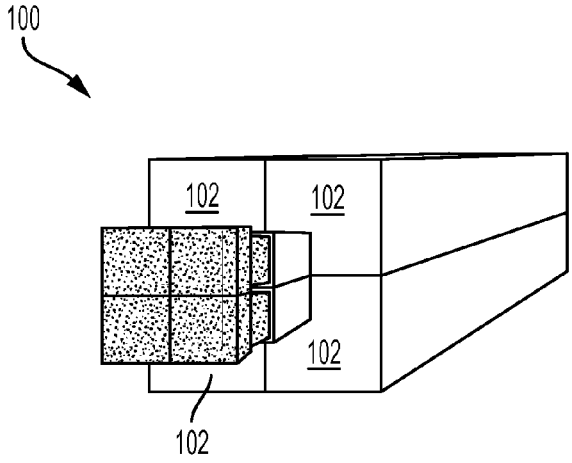
FIG. 25 is a cross-sectional drawing illustrating devices herein in a rolled-up position.

FIG. 23 illustrates that the individual containers 102 can be different than triangular or pouch-shaped structures in cross-section, and in FIG. 23 the bodies 116 are six-sided bodies in cross-section (were a five-sided body 116 is connected to the flat face wall 114). Similarly, in FIGS. 24 and 25 (where the container structure 100 is shown unrolled in FIG. 24 and rolled-up in FIG. 25) the individual containers can have a rectangular shape in cross-section. Note that with the rectangular-shaped individual containers 102 (in FIGS. 24 and 25) the joints 104 can be longer (larger) than the joints 104 used for triangular-shaped individual containers 102 shown in FIG. 1.

Figure 26:
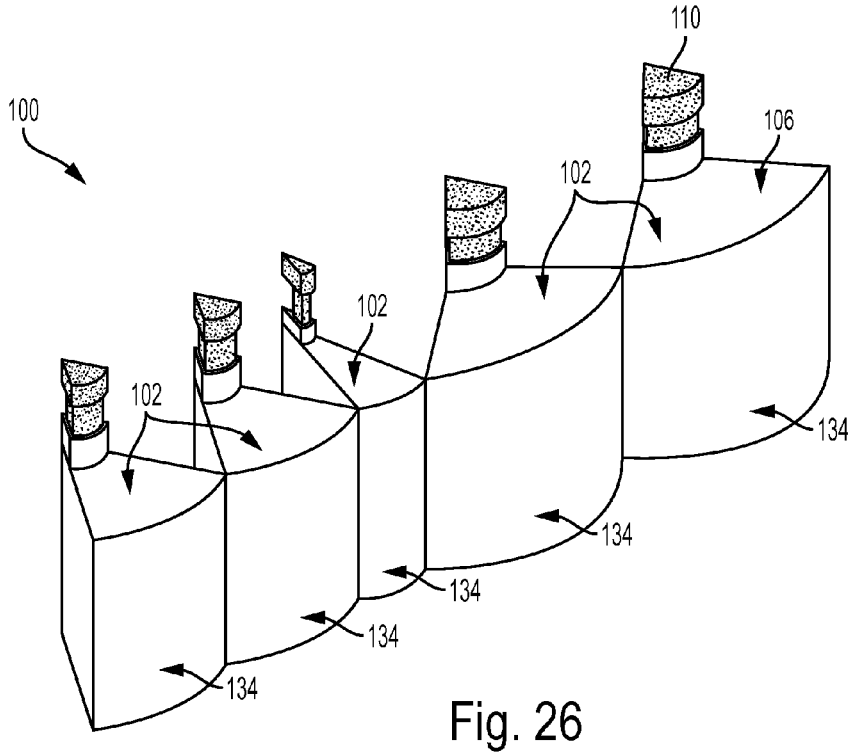
FIG. 26 is a perspective drawing illustrating devices herein in an unrolled position.
Figure 27:
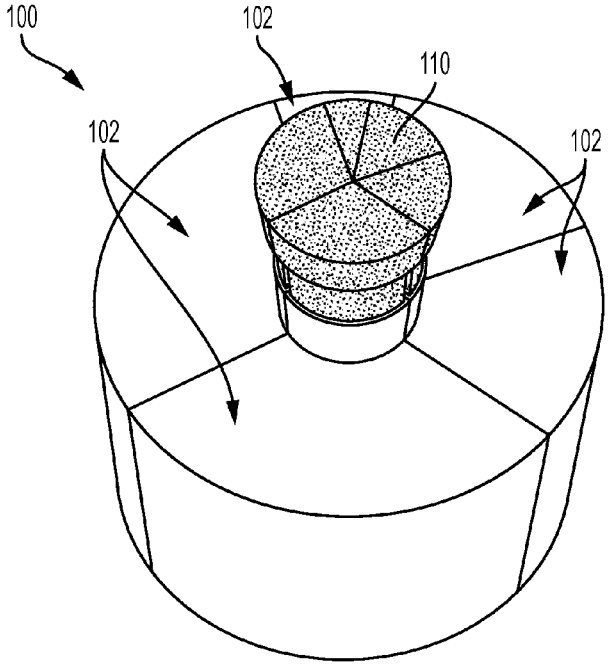
FIG. 27 is a perspective drawing illustrating devices herein in a partially rolled position.

FIGS. 26 and 27 illustrate an unrolled (FIG. 26) and rolled-up (FIG. 27) container structure 100, where the individual containers 102 include curved outer face walls 134 (in place of the flat face walls 114) that can be flexible or rigid; and these illustrated structures 100 otherwise maintain all the features discussed above with respect to the triangular structures shown in FIGS. 1-15.

An additional feature shown in FIGS. 18, 19, and 23 is a strip or band 150 that connects all of the caps 110 together. This strip or band 150 helps ensure that all the caps 110 will be positioned in the same location when the structure is rolled-up, and helps ensure that all the caps are simultaneously removed when the user twists the caps 110 off the rolled-up container structure 100.

All structures described herein can be made of any material capable of forming a watertight or airtight container, and such structures can be formed using any manufacturing process, whether currently known or developed in the future. For example, the container structures described herein can be formed of plastics, glasses, metals, alloys, rubbers, etc., or any combinations of such materials; and the structures herein can be fully (or have sections that are) transparent, translucent, non-transparent, etc. The container structures herein can be made using any manufacturing technique including, but not limited to injection molding, extrusion molding, stamping, patterning, lithography, material patterning/cutting/shaping/grinding, component assembly, etc. Further, some portions of the containers mentioned herein can be made of different materials than other portions of the containers or the entire container structure can be made of a single uniform material, depending upon the use of the container structure. Additional, the containers herein can be one-time-use containers, or can be reusable.

Therefore, the material makeup, appearance, size, shapes, etc., of the structures described herein can vary for different uses, so long as the flat base walls can be folded along the joints to allow the structure to be rolled-up from a flat state to a rolled-up state, where all the caps and openings are positioned adjacent one another when the structure is in the rolled-up state.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A multi-compartment container structure comprising:

individual containers connected together, all said individual containers having the same size and shape and comprising:

a triangular-shaped tubular body comprising three flat walls sealed to each other and forming a triangular shape in cross-section;

triangular end walls sealed to ends of said triangular-shaped tubular body; and a removable watertight and airtight cap connected to one of said triangular end walls, each of said individual containers being joined to immediately adjacent containers of said container structure by joints at wall edges of a flat base wall of said three flat walls, said joints having a greater flexibility relative to said flat base wall, said flat base wall of each said individual containers lying in a same plane when said container structure is in an unrolled state, each said flat base wall of said individual containers lying in different parallel planes when said multi-compartment container structure is in a rolled-up state, said rolled-up state occurring when two flat base walls of adjacent ones of said individual containers fold relative to one another along one of said wall edges, a combination of flat base walls of said individual containers forming a multi-planar exterior of said container structure when said container structure is in said rolled-up state, and said watertight and airtight caps of said individual containers being positioned adjacent each other when said container structure is in said rolled-up state.

2. The multi-compartment container structure according to claim 1, positions of said watertight and airtight caps of said individual containers when said container structure is in said rolled-up state allowing all said watertight and airtight caps of said container structure to be grasped and opened simultaneously.

3. The multi-compartment container structure according to claim 1, said individual containers comprising fill/dispense openings sealed by said watertight and airtight caps.

4. The multi-compartment container structure according to claim 1, said individual containers comprising fill/dispense openings positioned adjacent each other when said container structure is in said rolled-up state, said fill/dispense openings being sealed by said watertight and airtight caps.

5. The multi-compartment container structure according to claim 1, said individual containers comprising fill/dispense openings positioned adjacent each other, said fill/dispense openings being sealed by said watertight and airtight caps, and said fill/dispense openings being positioned to cause contents of said individual containers to mix when said container structure is in said rolled-up state and when said watertight and airtight caps are opened and said contents is poured out said fill/dispense openings.

6. The multi-compartment container structure according to claim 1, each of said individual containers maintaining contents when said watertight and airtight cap are sealing said individual containers, and said individual containers and said watertight and airtight caps preventing said contents maintained in different individual containers from mixing when said watertight and airtight caps are sealing said individual containers.

7. The multi-compartment container structure according to claim 1, each of said individual containers maintaining a liquid material or a granular dry material when said watertight and airtight cap are sealing said individual containers.

8. A multi-compartment container structure comprising:

individual containers connected together, all said individual containers having the same size and shape and comprising:

a tubular body comprising at least one flat wall;

end walls sealed to ends of said tubular body; and a removable watertight and airtight cap connected to one of said end walls, each of said individual containers being joined to immediately adjacent containers of said container structure by joints at wall edges of a flat base wall of said at least one flat wall, said joints having a greater flexibility relative to said flat base wall, said flat base wall of each said individual containers lying in a same plane when said container structure is in an unrolled state, each said flat base wall of said individual containers lying in different parallel planes when said multi-compartment container structure is in a rolled-up state, said rolled-up state occurring when two flat base walls of adjacent ones of said individual containers fold relative to one another along one of said wall edges, a combination of flat base walls of said individual containers forming a multi-planar exterior of said container structure when said container structure is in said rolled-up state, and said watertight and airtight caps of said individual containers being positioned adjacent each other when said container structure is in said rolled-up state.

9. The multi-compartment container structure according to claim 8, positions of said watertight and airtight caps of said individual containers when said container structure is in said rolled-up state allowing all said watertight and airtight caps of said container structure to be grasped and opened simultaneously.

10. The multi-compartment container structure according to claim 8, said individual containers comprising fill/dispense openings sealed by said watertight and airtight caps.

11. The multi-compartment container structure according to claim 8, said individual containers comprising fill/dispense openings positioned adjacent each other when said container structure is in said rolled-up state, said fill/dispense openings being sealed by said watertight and airtight caps.

12. The multi-compartment container structure according to claim 8, said individual containers comprising fill/dispense openings positioned adjacent each other, said fill/dispense openings being sealed by said watertight and airtight caps, and said fill/dispense openings being positioned to cause contents of said individual containers to mix when said container structure is in said rolled-up state and when said watertight and airtight caps are opened and said contents is poured out said fill/dispense openings.

13. The multi-compartment container structure according to claim 8, each of said individual containers maintaining contents when said watertight and airtight cap are sealing said individual containers, and said individual containers and said watertight and airtight caps preventing said contents maintained in different individual containers from mixing when said watertight and airtight caps are sealing said individual containers.

14. The multi-compartment container structure according to claim 8, each of said individual containers maintaining a liquid material or a granular dry material when said watertight and airtight cap are sealing said individual containers.

15. A multi-compartment container structure comprising:
individual containers connected together,
each of said individual containers having a flat base wall,
each of said individual containers being joined to immediately adjacent containers of said container structure by joints at wall edges of said flat base wall,
said joints having a greater flexibility relative to said flat base wall,
said flat base wall of each of said individual containers lying in a same plane when said multi-compartment container structure is in an unrolled state,
each said flat base wall of said individual containers lying in different parallel planes when said container structure is in a rolled-up state,
a combination of flat base walls of said individual containers forming a multi-planar exterior of said container structure when said container structure is in said rolled-up state,
said individual containers comprising watertight and airtight caps,
said watertight and airtight caps of said individual containers being positioned adjacent each other when said container structure is in said rolled-up state.

16. The multi-compartment container structure according to claim 15, positions of said watertight and airtight caps of said individual containers when said container structure is in said rolled-up state allowing all said watertight and airtight caps of said container structure to be grasped and opened simultaneously.

17. The multi-compartment container structure according to claim 15, said individual containers comprising fill/dispense openings sealed by said watertight and airtight caps.

18. The multi-compartment container structure according to claim 15, said individual containers comprising fill/dispense openings positioned adjacent each other when said container structure is in said rolled-up state, said fill/dispense openings being sealed by said watertight and airtight caps.

19. The multi-compartment container structure according to claim 15, said individual containers comprising fill/dispense openings positioned adjacent each other,
said fill/dispense openings being sealed by said watertight and airtight caps, and
said fill/dispense openings being positioned to cause contents of said individual containers to mix when said container structure is in said rolled-up state and when said watertight and airtight caps are opened and said contents is poured out said fill/dispense openings.

20. The multi-compartment container structure according to claim 15, each of said individual containers maintaining a contents when said watertight and airtight cap are sealing said individual containers, and said individual containers and said watertight and airtight caps preventing said contents maintained in different individual containers from mixing when said watertight and airtight caps are sealing said individual containers.

* * * * *

UNITED STATES PATENT AND TRADEMARK OFFICE

CERTIFICATE OF CORRECTION

PATENT NO. : 9,199,767 B1
APPLICATION NO. : 14/621542
DATED : December 1, 2015
INVENTOR(S) : Hirshol H. Pheir It is certified that error appears in the above-identified patent and that said Letters Patent is hereby corrected as shown below:

On the title page item (57) should read as follows:

A multi-compartment container structure has individual containers connected together. All the individual containers can have the same size and shape, and each has a flat base wall. Each of the individual containers is joined to immediately adjacent containers at wall edges of the flat base wall. The joints have a greater flexibility relative to the flat base wall. The flat base wall of each individual container lies in the same plane when the multi-compartment container structure is in an unrolled state. Each flat base wall of the individual containers lies in different parallel planes when the container structure is in a rolled-up state. The combination of flat base walls of the individual containers forms a multi-planar exterior of the container structure when the container structure is in the rolled-up state. The individual containers have watertight and airtight caps that are positioned adjacent each other when the container structure is in the rolled-up state.

Signed and Sealed this
Twenty-ninth Day of March, 2016

Michelle K. Lee

Michelle K. Lee
*Director of the United States Patent and Trademark Office*